US009174654B2

(12) United States Patent
Brandstetter et al.

(10) Patent No.: US 9,174,654 B2
(45) Date of Patent: Nov. 3, 2015

(54) DRIVE HAVING AXLE-MOUNTED TRANSMISSION FOR HIGH SPEEDS

(75) Inventors: Jochen Brandstetter, Graz (AT); Gerd Löffler, Empersdorf (AT); Hugo Rackl, Stattegg (AT); Herbert Reitmayr, Gmunden (AT); Thomas Weidenfelder, Judendorf-Straβengel (AT)

(73) Assignee: Siemens AG Oesterreich, Vienna (AT)

( * ) Notice: Subject to any disclaimer, the term of this patent is extended or adjusted under 35 U.S.C. 154(b) by 1187 days.

(21) Appl. No.: 12/682,817

(22) PCT Filed: Sep. 29, 2008

(86) PCT No.: PCT/EP2008/062997

§ 371 (c)(1),
(2), (4) Date: Jun. 16, 2010

(87) PCT Pub. No.: WO2009/056415

PCT Pub. Date: May 7, 2009

(65) Prior Publication Data

US 2010/0300324 A1 Dec. 2, 2010

(30) Foreign Application Priority Data

Oct. 31, 2007 (AT) ..... A 1769/2007

(51) Int. Cl.
*B61F 3/16* (2006.01)
*B61C 9/50* (2006.01)
*B61F 3/04* (2006.01)

(52) U.S. Cl.
CPC .... *B61C 9/50* (2013.01); *B61F 3/04* (2013.01)

(58) Field of Classification Search
USPC ..... 105/96–101, 182.1, 184
See application file for complete search history.

(56) References Cited

U.S. PATENT DOCUMENTS 3,244,117 A * 4/1966 Yuhas ..... 105/96.1
4,526,107 A * 7/1985 Mautner et al. ..... 105/133
5,520,117 A * 5/1996 Teichmann et al. ..... 105/139

FOREIGN PATENT DOCUMENTS

CH 331740 A 7/1958
CN 2910704 Y 6/2007

(Continued)

OTHER PUBLICATIONS

Blaser E et al: "Achsantriebe für elektrische Schienenfahrzeuge" Brown Boveri Review, Brown Boveri and Co. Baden, CH, Bd. 64, Jan. 1, 1977, pp. 714-723, XP000764887 Abbildungen 5,6,13.

*Primary Examiner* — R. J. McCarry, Jr.
(74) *Attorney, Agent, or Firm* — Laurence A. Greenberg; Werner H. Stemer; Ralph E. Locher

(57) ABSTRACT

A bogie for locomotives is provided. Two wheelsets, each including a drive unit, are disposed in a bogie frame, wherein the wheelsets each include a wheelset shaft and two wheels. The drive unit comprises a motor unit and a transmission disposed to ride on an axle, and each motor unit is suspended at three points, namely at a main pivot point on the transverse beam of the bogie frame and two mounting points on a head beam of the bogie frame. Further, the motor unit is transversally elastically suspended; the transmission is mounted pivotally about the wheelset shaft but not displaceable along the wheelset shaft. The transmission is further connected to the motor unit by a transmission torque support, and the drive unit comprises a clutch by which the motor unit has a driving connection to the wheelset by the transmission.

20 Claims, 3 Drawing Sheets

(56) References Cited

FOREIGN PATENT DOCUMENTS

| | | | |
|---|---|---|---|
| DE | 2614520 | A1 | 1/1977 |
| DE | 9214101 | U1 | 12/1992 |
| DE | 4230549 | A1 | 3/1994 |
| EP | 0589864 | A1 | 3/1994 |
| EP | 0589866 | A1 | 3/1994 |
| EP | 1116634 | A1 | 7/2001 |
| EP | 1712442 | A1 | 10/2006 |
| RU | 2307750 | C1 | 10/2007 |

* cited by examiner

DRIVE HAVING AXLE-MOUNTED TRANSMISSION FOR HIGH SPEEDS

CROSS REFERENCE TO RELATED APPLICATIONS

This application is the US National Stage of International Application No. PCT/EP2008/062997 filed Sep. 29, 2008, and claims the benefit thereof. The International Application claims the benefits of Austrian Application No. A1769/2007 AT filed Oct. 31, 2007. All of the applications are incorporated by reference herein in their entirety.

FIELD OF INVENTION

The invention relates to a bogie for locomotives.

Two driving wheelsets with an associated drive unit are generally arranged in the bogie frame, the drive unit being suspended in the bogie frame.

BACKGROUND OF INVENTION

The simplest type of suspension for drive units in this case is the nose-suspension drive. DE 195 30 155 A1 describes a solution of this type in which the motor is supported on one side by two nose bearings on the wheel axle of the driving wheels and is held on the bogie on the other side in a sprung manner. In this arrangement motor and transmission are disposed so as to ride on the axle. With this type of drive the mass of the motor and transmission rests for the most part unsprung on the wheelset. The disadvantage of this nose-bearing connection is that forces (accelerations) resulting from track unevennesses are transferred directly to the drive. This effect is amplified as the speed increases. Large unsprung masses or moments of inertia of the primarily sprung masses give rise to instabilities and very high forces between wheel and rails, thus making other solutions necessary.

The horizontal oscillation characteristics in particular become detrimentally noticeable at speeds in excess of approximately 140 km/h, wherein a translational oscillation having an amplitude that is directed transversely relative to the track is generally overlaid with a rotary oscillation about a perpendicular axis to produce a rocking motion.

This problem of running stability or running safety with regard to driven rail vehicles is addressed in various ways.

For example, use is frequently made of the effect that is generally known in technological terms as absorption, in order to influence lateral oscillations and rotary oscillations about the normal axis of the chassis and thereby significantly to improve the stability of the vehicle. In the case of absorption characteristic frequencies of the bogie or locomotive are overlaid and attenuated by the oscillation of an additional oscillating mass.

This effect is achieved by decoupling the masses of the drive from the rest of the chassis. In terms of operational running (unstable running characteristics), decoupling is primarily necessary at high speeds, which is why heavy locomotive drives having axle-mounted transmission operate at speeds of up to only 160 km/h at present.

In locomotive bogies for high speeds of up to and exceeding 300 km/h, use is made of e.g. fully sprung hollow shaft drives. In this case motor and transmission are decoupled from the wheelset and the transfer of force to the wheelset takes place via a hollow shaft which encloses the whole wheelset shaft. This solution is very expensive and heavy due to its complex, resource-intensive construction.

EP 0 444 016 B1 shows an example of such a solution. In this case the running motor and the flanged transmission are elastically suspended in the bogie frame via vertically disposed leaf springs in each case, and therefore act jointly as absorbers for lateral and rotary oscillations about the normal axis of the bogie. This solution has disadvantages in terms of the complex and resource-intensive construction, the considerable weight and the high costs caused by the requirement for the installation of a hollow shaft.

A bogie is known from EP 0 589 866 B1. In that case, however, the transmission is directly flanged onto the running motor and the motor transmission unit is suspended in the bogie by means of sprung elements. In addition to the considerable weight, the complex, resource-intensive construction and the high costs of this solution are disadvantageous.

SUMMARY OF INVENTION

An object of the invention is to design a motor bogie having an axle-mounted transmission and able to be operated at speeds in excess of 160 km/h as well as being inexpensive to manufacture.

Taking as a starting point a bogie of the type cited in the introduction, this object is achieved in that the motor unit is suspended in a transversely elastic manner, the transmission is mounted rotatably about the wheelset shaft, though not displaceably along the wheelset shaft, and the drive unit comprises a clutch by means of which the motor unit has a driving connection to the wheelset via the transmission.

It is of inventive merit that a bogie is produced in which the drive unit is arranged in such a way as to significantly reduce both transverse oscillations relative to the direction of travel of the rail vehicle and rotary oscillations about the normal axis of the bogie. The motor unit acts as an absorber by virtue of its transversely elastic suspension.

The clutch allows the decoupling of motor unit and axle-mounted transmission, this proving beneficial since relative movements occur between the oscillatingly suspended motor unit and the transmission. The clutch additionally transfers the torque from the motor unit to the transmission and the wheelset shaft. The clutch is arranged such that it is connected to the motor shaft in this case.

The transmission is advantageously connected to the bogie frame via a transmission torque support. The transmission torque is therefore diverted to the bogie frame.

In a variant of the invention the transmission is connected to the motor unit via a transmission torque support.

As a result of the transmission being connected to the motor unit via a torque support, firstly a linkage point on the chassis frame is economized, and secondly the relative movements between motor unit and clutch, and hence also the coupling paths when the vehicle is jouncing, are reduced during operation. By virtue of this solution it is possible to run at high speeds with large masses, which was not possible in the prior art using comparable bogies or drive systems having axle-mounted transmission.

The transversely elastic suspension of the motor unit is advantageously realized by means of two pendulum-type connection pieces which are used to suspend the motor unit from the two mounting points on the head beam of the bogie frame.

In this case the end regions of the pendulum-type connection pieces have bearings of a certain torsional stiffness, which to a limited degree allow movements in all spatial directions. Various embodiments of the pendulum-type connection pieces are conceivable in principle, e.g. they could also be realized as leaf springs.

A particularly beneficial effect of the transmission torque support can be achieved if the point at which the transmission torque support is connected to the motor unit is arranged as closely as possible to the clutch. In this arrangement the clutch is disposed such that it is connected to the motor shaft. As closely as possible is understood here to signify an arrangement in which the transmission torque support is attached as near to the clutch as possible within the design constraints such that proper functioning of the clutch is still ensured. The ideal position of the transmission torque support is at exactly the height of the motor shaft in the longitudinal direction of the vehicle. Specifically, the point at which the transmission torque support is attached to the housing of the motor unit should therefore be arranged as closely as possible to the location at which the motor shaft emerges from the housing of the motor unit. Such an arrangement of the transmission torque support results in the relative movement between clutch and motor unit being reduced to a minimum when the rail vehicle is jouncing during travel, thereby causing less wear to the individual components of the drive unit.

The transmission torque support is advantageously embodied as a pendulum-type connection piece. In the same way as the connection pieces which are used for suspending the motor unit from the head beam of the bogie frame, the pendulum-type connection piece here consists of a type of axle which has bearings at its ends, said bearings allowing movement of the transmission torque support.

An advantageous suspension of the motor unit in the bogie according to the invention can be realized if the suspension of the motor unit from the head beam of the bogie frame is effected by means of at least one bracket, wherein the connection between bracket and the mounting points is made via at least one exchangeable bracket adapter.

The bracket is essentially arranged horizontally in this case. In addition to the variant having precisely one bracket, this being the simplest possible embodiment, use is preferably made of two brackets, thereby allowing the implementation of a simpler connection to the mounting points or the bracket adapters. The bracket adapters are preferably bolted or welded onto the brackets.

Two pairs of brackets which are arranged adjacently to each other and consist in each case of an upper and a lower bracket are advantageously provided.

This provides a construction that is particularly stable, and furthermore the connection between brackets and bracket adapters can also be designed to give greater stability.

As a result of the connection between the bracket adapters and the mounting points on the bogie frame being established via the bracket adapters it is possible to realize a modular design format which allows the bogie frame to be tailored to the planned field of application in each case.

In a variant of the invention the bracket adapters are embodied in such a way that, for example, they are connected directly to the mounting points on the head beam of the bogie frame in a rigid manner.

Such an embodiment can be used e.g. for rail vehicles which have a maximum speed of 160 km/h. Such an embodiment makes it possible to dispense with limiting stop means and damping elements, for example, since the rigid connection prevents any oscillating motion of the motor unit, in addition to which no pendulum-type connection pieces are required, thereby significantly reducing the costs of such a bogie.

In a further variant the bracket adapters are embodied such that the connection of a bracket adapter to the mounting point on the head beam of the bogie frame is effected by means of a pendulum-type connection piece.

By virtue of this pendulum suspension, which is effected as a result of using pendulum-type connection pieces, greater masses and speeds can be realized for rail vehicles having the bogie according to the invention. Speeds in excess of 160 km/h are possible in this way.

Lateral and rotary oscillations relative to the normal axis of a bogie according to the invention can be reduced further if a damping element which acts transversely relative to the longitudinal axis of the bogie is provided in a manner known per se between the drive unit and the bogie frame.

This damping element can be a pneumatic or hydraulic damper, for example, though other embodiments using rubber or elastomer elements are also conceivable. The arrangement of such a damping element allows the absorption effect to be optimized due to the improved balancing characteristics of the drive unit or motor unit relative to the bogie frame.

In a further embodiment of the invention at least one limiting stop device which restricts the transverse movement of the motor unit relative to the longitudinal axis of the bogie frame is arranged on the head beam.

This enables the amplitude of the pendulum motion of the motor unit to be held within predefined limits, thereby preventing the bogie from being damaged by the motor unit or drive unit.

BRIEF DESCRIPTION OF THE DRAWINGS

Further advantages and details of the invention will emerge from the following description of exemplary embodiments with reference to the drawing and in conjunction with the features characterized in the claims. In the drawing:

DETAILED DESCRIPTION OF INVENTION

Figure 1:
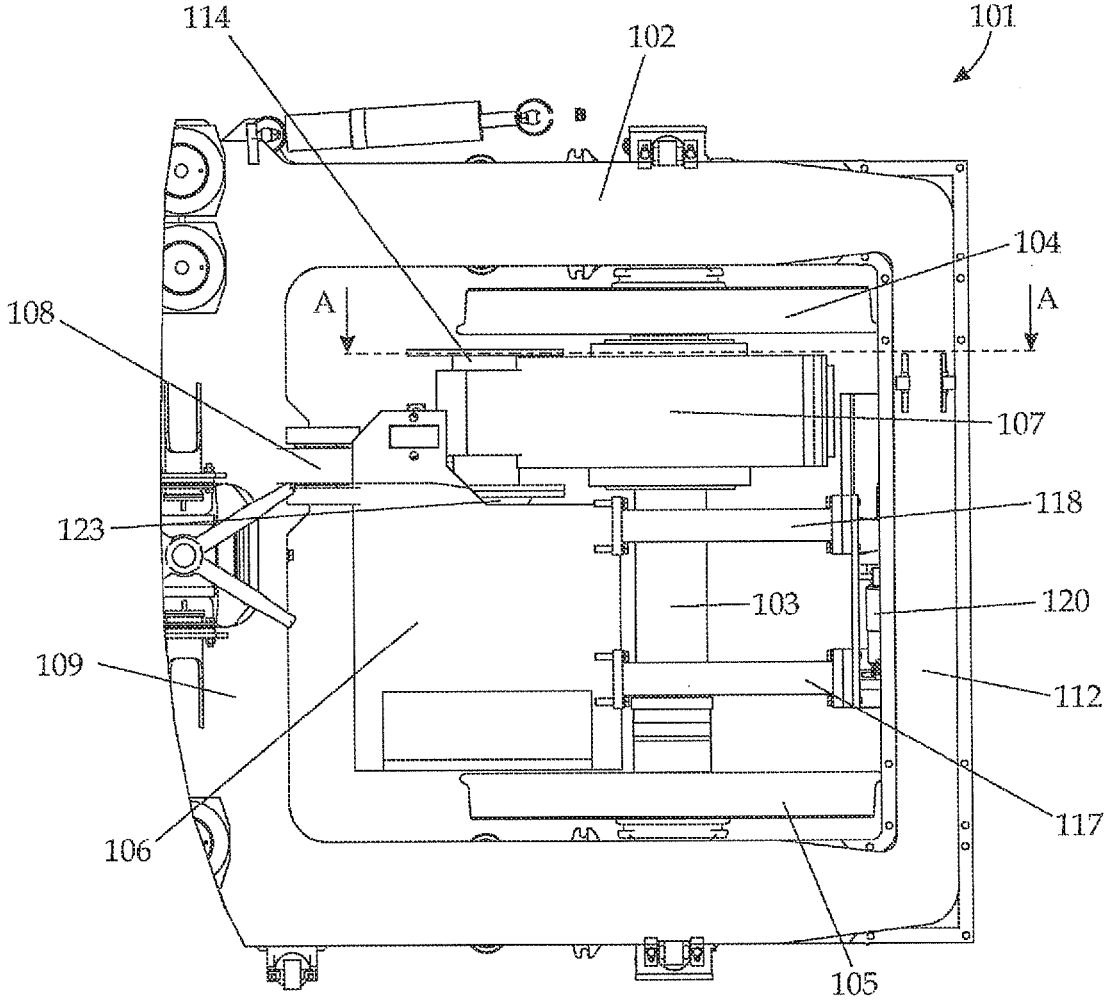
FIG. 1 shows a partial plan view of the bogie according to the invention.

The figures each show sections of a bogie 101 in which two wheelsets are mounted in a conventional manner and are each driven by a motor unit 106. FIG. 1 shows the right-hand side of a bogie frame 102 of a bogie 101 according to the invention, the transverse beam 109 being illustrated on the left-hand side of FIG. 1 and the head beam 112 being illustrated on the right-hand side. A driving wheelset consisting of a wheelset shaft 103 and two wheels 104, 105 is also illustrated. The wheelset has limited movement relative to the bogie frame 102.

FIG. 1 also shows a drive unit consisting of a motor unit 106, a transmission 107 and a clutch 114. The components of the clutch 114, e.g. two coupling stars for transferring the rotational moment from the motor unit 106 to the wheelset shaft 103, are arranged directly behind the motor shaft 123.

The transmission 107 is axle-mounted on the wheelset shaft 103, being supported such that it is rotatable about the wheelset shaft 103 but not displaceable along said shaft. The drive unit is suspended at three positions in the bogie frame 102, specifically at the main pivot point 108 on the transverse beam 109 and at two mounting points 110, 111 which cannot be seen in FIG. 1 because they are hidden by the head beam 112.

Figure 4:
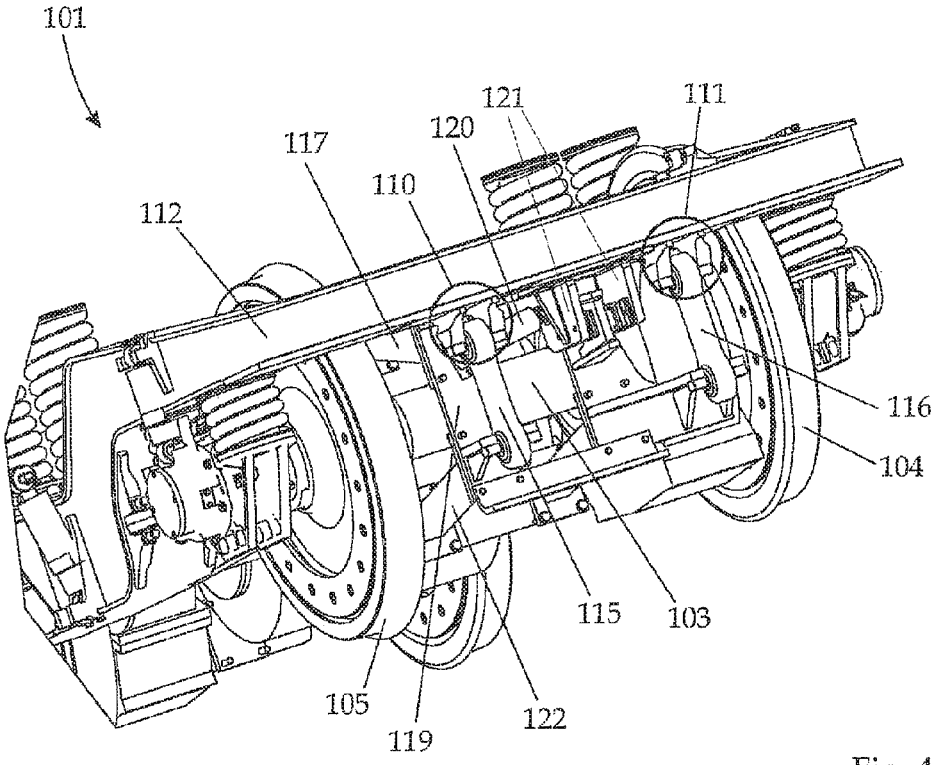
FIG. 4 shows a perspective partial illustration of the bogie according to the invention.

The connection between motor unit 106 and the mounting points 110, 111 on the head beam 112 of the bogie frame 102 is made by means of brackets 117, 118, each of which has a bracket adapter 119 (FIG. 4) that is arranged at the end nearest to the head beam 112, wherein said bracket adapters 119 are likewise hidden by the head beam 112 in FIG. 1. In the present embodiment of the invention two pairs of brackets 117, 118 which are arranged adjacently to each other are provided. As can be seen from FIG. 4, an upper bracket 117 and a lower bracket 122 are provided in each case. Both brackets are connected to the bracket adapter 119 here. In principle it would also be possible to conceive of a suspension having only one bracket, and variants having more than four brackets are obviously also possible. As a result of providing two pairs of brackets, each consisting of an upper bracket 117, 118 and a lower bracket 122 and being connected to the bogie frame 102 by means of a bracket adapter 119, it is also possible to realize modular solutions for the suspension of the motor unit 106 in the bogie frame 102. Moreover the structural stability of the suspension is improved by virtue of this solution.

For example, the bracket adapter 119 can be realized in such a way that, by transposing the upper 117, 118 and lower 122 brackets, a rigid non-pendulum connection to the bogie frame 102 or the head beam is possible. It is therefore possible, using the same components, to realize both a rigid and a pendulum suspension of the motor unit 106.

Furthermore, this modular structure also makes it possible to remove the wheelset shaft 103 while the motor unit 106 remains mounted in the bogie frame 102. This possibility is clearly visible in FIG. 4: by removing the lower brackets 122, the axle can be removed without any need for further modification of the bogie 101.

Figure 2:
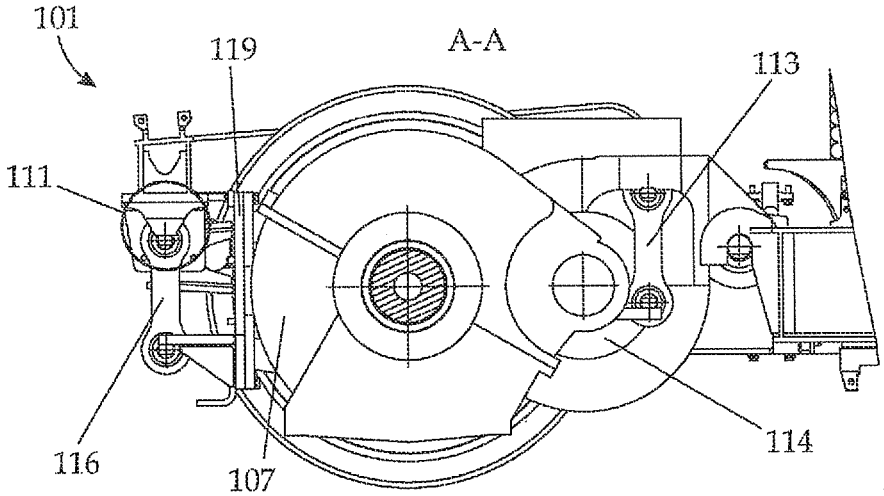
FIG. 2 shows a partial cross-section of the bogie from FIG. 1 along the line A-A.
Figure 5A:
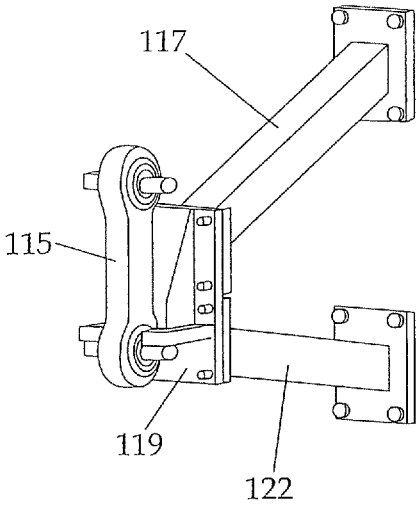
FIG. 5*a* shows the brackets for suspending the motor unit in the bogie frame in an embodiment which allows a pendulum suspension.
Figure 5B:
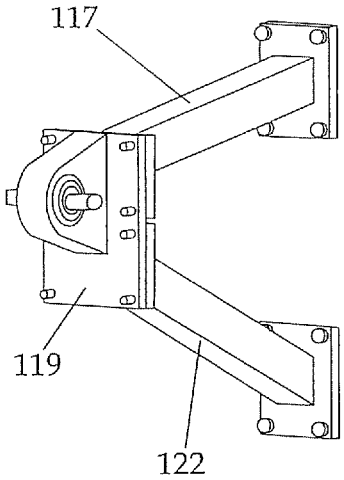
FIG. 5*b* shows the brackets for suspending the motor unit in the bogie frame in an embodiment which allows a pendulum suspension.

FIG. 5*a* shows the brackets 117, 122 in detail—the connection of the brackets 117, 122 to the bogie frame 102 in this embodiment is effected by means of a pendulum-type connection piece 115 which is connected via the bracket adapter 119 to the brackets 117, 122. The embodiment variant in which a rigid connection of the brackets 117, 122 (and hence the motor unit 106) to the bogie frame 102 is provided, is shown in FIG. 5*b*. Such a variant makes it possible to dispense with limiting stop devices, lateral dampers and the like. It is evident from FIGS. 5*a* and 5*b* that the two possible variants can essentially be realized by merely inverting the brackets—the upper bracket is then the lower bracket in each case and vice versa. FIG. 2 shows a section through the bogie 101 from FIG. 1 along the line A-A. It can be seen here that pendulum-type connection pieces 115, 116 are disposed between the bracket adapters 119 and the mounting points 110, 111, thereby providing a pivotable support of the drive unit or motor unit 106 in the bogie frame 102. Said pendulum-type connection pieces 115, 116 are also clearly visible in the FIGS. 3 and 4. The attachment of the connection pieces 115, 116 to the bracket adapters 119 is effected by means of a bearing with a degree of torsional stiffness, thereby allowing a pendulum motion of the motor unit 106 which can then function inventively as an absorber mass.

Pendulum-type, in the present context, is understood to signify a device which can be caused to oscillate as a result of displacement from its position of rest and which can oscillate about the central lowest point of the center of mass. In the present case this means that the motor unit 106 which is suspended from the pendulum-type connection pieces 115, 116 in the bogie frame 102 is caused to oscillate due to accelerations which can occur during the travel of a rail vehicle, and so to function as an absorber mass for the bogie 101. This oscillating motion is also defined by the support in the main pivot point 108 on the transverse beam 109 (and by the pendulum suspension on the head beam) of the bogie frame 102.

The pendulum-type connection pieces 115, 116 can also be realized as leaf springs in this case.

Figure 3:
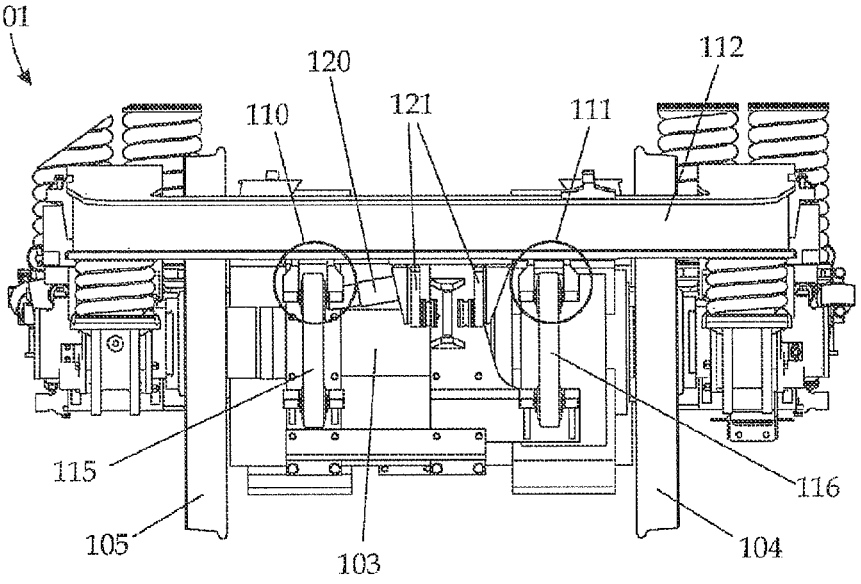
FIG. 3 shows a partial front view of the bogie according to the invention.

As shown in FIG. 3, a damping unit 120 which is suitable for damping the motor movement and which is installed transversely relative to the longitudinal axis of the bogie 101 is additionally provided between the drive unit and the bogie frame 102. Said damping unit 120 can be e.g. hydraulic or pneumatic in its implementation, but can also be embodied otherwise. The damping unit 120 is also partially visible in FIGS. 1 and 4. The arrangement of the transmission torque support 113 on the housing of the motor unit 106 is also advantageous. The transmission torque support 113 is arranged between the transmission 107 and the motor unit 106. The transmission torque support 113 is attached to the housing of the motor unit 106 in this case.

In order to achieve an advantageous effect of the transmission torque support 113, the latter is arranged on the housing of the motor unit 106 as closely as possible to the location at which the motor shaft 123 emerges therefrom. The ideal position of the transmission torque support is at exactly the height of the motor shaft in the longitudinal direction of the vehicle. As closely as possible, in the present context, is understood to signify the smallest distance that is acceptable in design terms while allowing the transmission 107 and clutch 114 to function correctly. The smaller the distance, the less the relative movement between transmission 107 and motor unit 106 when the bogie 101 jounces under operating conditions. The reduction in relative movements has a positive effect on clutch wear in this case.

The transmission torque support 113 is embodied as a pendulum-type connection in the same way as the suspensions of the motor unit 106 from the head beam 112 of the bogie frame 102.

This torque support has the effect of both eliminating the need for a connection point on the bogie frame 102 and minimizing the coupling paths when the vehicle is jouncing during operation.

Figure 6:
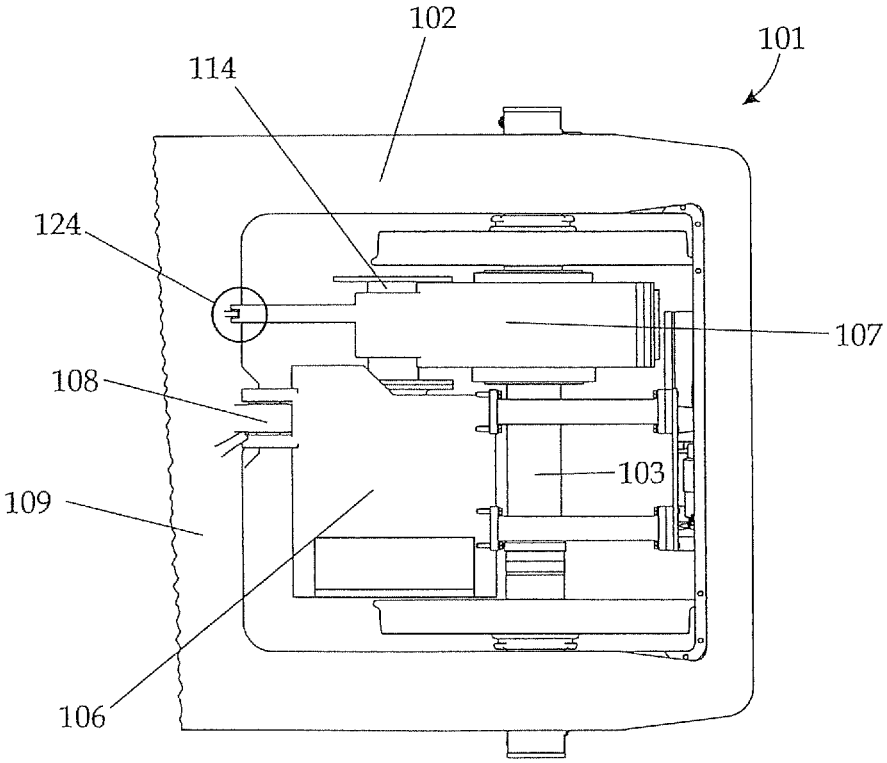
FIG. 6 shows part of a plan view of the bogie according to the invention in which the transmission is supported on the bogie frame.

In a further embodiment of the invention, provision is made for connecting the transmission torque support 113 to the transverse beam 109 of the bogie frame 102 instead of to the motor unit 106. Such a solution is illustrated in FIG. 6, where the transmission pivot point 124 is disposed on the transverse beam 109 of the bogie frame 102. It should be noted that the illustration in FIG. 6 is merely schematic, and that an actual embodiment will be slightly different according to the actual requirements.

In order to prevent the motor unit 106 from oscillating excessively, a limiting stop device 121 is arranged on the bogie frame 102 and cushions the excessive amplitudes of the oscillating motor unit 106. Possible damage to the bogie 101 by the motor unit 106 can be prevented thus.

In principle it is possible to realize different drive variants with the bogie according to the invention. For example, a pinion hollow shaft drive which is mounted permanently on the frame can also be suspended from the three mounting points that are provided. It is additionally possible to install an elastic pinion hollow shaft drive as proposed immediately above, and incorporate a conventional hollow shaft drive comprising an elastic connection for high speeds.

The invention claimed is:

1. A bogie for locomotives, comprising:

a bogie frame;

two wheelsets, each wheelset including a wheelset shaft, two wheels and a drive unit, the two wheelsets being disposed in the bogie frame, wherein the drive unit includes a motor unit and an axle-mounted transmission, the motor unit being suspended from three points, specifically from a main pivot point on the transverse beam of the bogie frame and from two mounting points on a head beam of the bogie frame, the motor unit being suspended in a transversely elastic manner, wherein the drive unit has a clutch by which the motor unit has a driving connection to the wheelset via the transmission, and wherein the transmission is mounted rotatably about the wheelset shaft, the transmission being not displaceable along the wheelset shaft, and wherein the clutch is configured to allow relative movement between the motor unit and the transmission.

2. The bogie as claimed in claim 1, wherein the transmission is connected to the bogie frame via a transmission torque support.

3. The bogie as claimed in claim 2, wherein the transversely elastic suspension of the motor unit is embodied by two pendulum-type connection pieces which are used to suspend the motor unit from the two mounting points on the head beam of the bogie frame.

4. The bogie as claimed in claim 2, wherein the transmission torque support is embodied as a pendulum-type connection piece.

5. The bogie as claimed in claim 2, wherein a damping element acting transversely relative to a longitudinal axis of the bogie is provided between the drive unit and the bogie frame.

6. The bogie as claimed in claim 2, wherein a limiting stop device is arranged on the head beam and restricts the transverse movement of the motor unit relative to the longitudinal axis of the bogie frame.

7. The bogie as claimed in claim 1, wherein the transmission is connected to the motor unit via a transmission torque support.

8. The bogie as claimed in claim 7, wherein the transversely elastic suspension of the motor unit is embodied by two pendulum-type connection pieces which are used to suspend the motor unit from the two mounting points on the head beam of the bogie frame.

9. The bogie as claimed in claim 7, wherein the point at which the transmission torque support is connected to the motor unit is arranged as closely as possible to the clutch.

10. The bogie as claimed in claim 7, wherein the transmission torque support is embodied as a pendulum-type connection piece.

11. The bogie as claimed in claim 1, wherein the transversely elastic suspension of the motor unit is embodied by two pendulum-type connection pieces which are used to suspend the motor unit from the two mounting points on the head beam of the bogie frame.

12. The bogie as claimed in claim 11, wherein the point at which the transmission torque support is connected to the motor unit is arranged as closely as possible to the clutch.

13. The bogie as claimed in claim 1, wherein the suspension of the motor unit from the head beam of the bogie frame is effected by a bracket, wherein a connection between the bracket and the mounting points is effected via an exchangeable bracket adapter.

14. The bogie as claimed in claim 13, wherein two pairs of brackets are provided which are arranged adjacently to each other, each pair of brackets comprising an upper and a lower bracket.

15. The bogie as claimed in claim 14, wherein bracket adapters are connected directly to the mounting points of the head beam of the bogie frame in a rigid manner.

16. The bogie as claimed in claim 14, wherein bracket adapters are embodied such that a connection of the bracket adapters to the mounting point on the head beam of the bogie frame is effected by a pendulum-type connection piece.

17. The bogie as claimed in claim 13, wherein the bracket adapter is connected directly to the mounting points on the head beam of the bogie frame in a rigid manner.

18. The bogie as claimed in claim 13, wherein the bracket adapter is embodied such that a connection of the bracket adapter to the mounting point on the head beam of the bogie frame is effected by a pendulum-type connection piece.

19. The bogie as claimed in claim 1, wherein a damping element acting transversely relative to a longitudinal axis of the bogie is provided between the drive unit and the bogie frame.

20. The bogie as claimed in claim 1, wherein a limiting stop device is arranged on the head beam and restricts the transverse movement of the motor unit relative to the longitudinal axis of the bogie frame.

* * * * *